US005486044A

United States Patent [19]

Bennett

[11] Patent Number: 5,486,044

[45] **Date of Patent: * Jan. 23, 1996**

[54] COOLER DOOR DISPLAY RACK

[76] Inventor: James L. Bennett, 7516 Hayes Cir., Ralston, Nebr. 68127

[ * ] Notice: The portion of the term of this patent subsequent to Jul. 19, 2011, has been disclaimed.

[21] Appl. No.: 235,644

[22] Filed: Apr. 29, 1994

Related U.S. Application Data

[63] Continuation-in-part of Ser. No. 833,107, Feb. 10, 1992, Pat. No. 5,330,261.

[51] Int. Cl.[6] ..... A47F 5/00; A47F 3/06

[52] U.S. Cl. ..... 312/321.5; 312/129; 40/597; 211/88

[58] Field of Search ..... 312/126, 129, 312/130, 234.1, 234.4, 234.5, 321.5, 408; 40/597, 611, 649; 211/74, 75, 88; 248/206.3, 206.4

[56] References Cited

U.S. PATENT DOCUMENTS

| | | | |
|---|---|---|---|
| 1,885,103 | 11/1932 | Barnett | 40/597 |
| 2,074,785 | 3/1937 | Gentz | 211/75 |
| 4,171,584 | 10/1979 | Kaiser | 40/597 |
| 4,560,072 | 12/1985 | Burrell | 211/75 |
| 4,984,693 | 1/1991 | Belokin | 211/88 |
| 5,007,190 | 4/1991 | Shyu | 40/611 |
| 5,096,272 | 3/1992 | Belokin | 312/321.5 |
| 5,131,177 | 7/1992 | Sy | 40/597 |
| 5,162,696 | 11/1992 | Goodrich | 40/597 |
| 5,351,841 | 10/1994 | Belokin | 248/206.3 |
| 5,358,128 | 10/1994 | Belokin | 211/75 |

FOREIGN PATENT DOCUMENTS

| | | | |
|---|---|---|---|
| 8100314 | 6/1991 | Switzerland | 211/75 |

*Primary Examiner*—Flemming Saether
*Attorney, Agent, or Firm*—John A. Beehner

[57] ABSTRACT

A cooler door display rack includes an elongated support shelf of a shape for supporting a plurality of beverage containers generally in a row, the shelf having front and back edges. An advertisement display device is operatively associated with the support shelf for removably and replaceably receiving and supporting advertising indicia in upright relation adjacent the front edge of the support shelf. The advertisement display device is of a size and shape such that advertising indicia supported therein substantially span the length of the shelf. A retention device operatively associated with the support shelf retains beverage containers on the support shelf and obstructs sliding movement of beverage containers off of the shelf. Finally, a securement device for securing the shelf to the inside surface of a transparent door of a cooler is included, the shelf arranged such that advertising indicia supported on the advertisement display device are arranged adjacent to and visible through the transparent door of the cooler.

13 Claims, 4 Drawing Sheets

COOLER DOOR DISPLAY RACK

CROSS-REFERENCE TO RELATED APPLICATION

This is a continuation-in-part application of patent application Ser. No. 07/833,107 filed Feb. 10, 1992 now U.S. Pat. No. 5,330,261, issued Jul. 19, 1994, for a Cooler Door Display Rack.

BACKGROUND OF THE INVENTION

1. Technical Field

This invention relates generally to a method and apparatus for providing additional display and advertising space for products in a retail store. Note specifically, the invention provides a novel method and apparatus for providing additional retail display and advertising space by means of a rack which may be secured to the door of a conventional refrigerated storage cooler.

2. Description of the Prior

Storage racks on the inside surfaces of a storage compartment door are known. Several prior art devices have been disclosed wherein a rack, bottle holder, or shelves are secured to the inside of a conventional household refrigerator door. Additionally, devices such as that disclosed in Barger, U.S. Pat. No. 906,368 have been designed for display of items such as saws in a cabinet, wherein the item may be secured to the cabinet glass door so as to be visible to one looking into the cabinet. In Crofts, U.S. Pat. No. 769,647, a shop window casing apparatus for displaying products to customers was disclosed wherein the casing was pivoted outward to facilitate selection of a product therefrom.

In still another example of prior art, a refrigerator apparatus was disclosed in Hill, U.S. Pat. No. 1,879,241, which included the capability to mount a single product container onto the glass door. The product itself was not easily accessible to the customer since the container itself was secured to the door. Additionally, the glass door of the refrigerator is mounted at an angle making viewing at a distance difficult. Further, the refrigerator door was not adapted to receive advertising or promotional messages.

Belokin, Jr. et al., and Belokin, Jr. et al., U.S. Pat. Nos. 4,984,693 and 5,096,272, both disclose display shelves, Belokin '272 disclosing an adjustable width display shelf having an interconnect structure. Belokin '272 discloses small single-use stickers for adjusting the shelf to a selected length, but it has no provision for displaying large, reusable attention-grabbing advertising placards.

Doors in a modern cooler are vertically mounted and pivot outwardly when opened by a customer retrieving a product stored therein. Products are stored in the cooler or storage compartment on vertically spaced, generally horizontal racks. The racks are mounted a distance behind the door thus creating a space which is empty and through which cooling air may circulate.

Thus it can be seen that none of the prior art devices provide the advantages of the present invention, wherein a display rack is secured to the surface of a transparent door of a modern cooler or storage compartment, thereby providing an apparatus capable of receiving and storing products in a space otherwise unused, increasing efficiency of the cooler, and further providing for the display of advertising or promotional messages to consumers.

3. Objects of the Invention

Accordingly, a primary object of the invention is to provide supplemental product storage and advertising space on the interior surface of the transparent door of cooler.

Another object of the present storage and display rack apparatus is to provide additional storage space in existing coolers, thereby more effectively utilizing existing space within such coolers and conserving energy.

It is an additional objective to provide a display and storage rack apparatus which may be secured to the interior surface of a conventional cooler door.

It is an additional objective to provide a storage display rack apparatus which may receive advertising or promotional message placards therein for display to the consuming public at the point of sale.

It is a further objective of the present invention to provide a display rack apparatus which may utilize an electronic message board as the message placard.

It is a further objective of the present invention to provide an apparatus which may be used on the large transparent doors of walk-in storage compartments.

It is a further objective of the invention that it be easily removed from the door, yet be sturdily attached when secured thereto.

It a further objective that the advertising or promotional message be easily changed in the display rack.

It is an additional objective that the display storage rack be of sturdy construction yet be relatively inexpensive and easy to manufacture.

SUMMARY OF THE INVENTION

A cooler door display rack includes an elongated support shelf of a shape for supporting a plurality of beverage containers generally in a row, the shelf having front and back edges, and an advertisement display operatively associated with the support shelf for removably and replaceably receiving and supporting advertising indicia in upright relation adjacent the front edge of the support shelf. The advertisement display is of a size and shape such that advertising indicia supported therein span substantially the length of the shelf. The display rack further includes a retention device operatively associated with the support shelf for retaining beverage containers thereon and obstructing the sliding movement of beverage containers off of the shelf. Finally, the display rack includes at least one securement device for securing the shelf to the inside surface of a transparent door such that advertising indicia supported on the advertisement display are arranged adjacent to and visible through the transparent door.

The cooler door display rack is designed to be mounted in a cooler having a frame at least partially defining a cooling compartment, a transparent door pivotally mounted on the frame and having interior and exterior faces, storage racks mounted in vertically spaced apart relation within the cooling compartment and in horizontally spaced relation from the door, with the space between the door and the storage racks defining a cooling air flow zone.

The cooler door display rack thus provides a substantial improvement over those devices found in the prior art. For example, the advertisement display of the present invention allows for substantially larger advertising to be displayed by the present invention. Furthermore, advertisements may be removed and replaced into the advertising display without destroying the advertisements. Therefore, it is clear that the present invention provides a substantial improvement over those devices found in the prior art.

Alternatively, the invention includes a cooler having a frame at least partially defining a cooling compartment, a transparent door pivotally mounted on the frame and having interior and exterior faces, storage racks mounted in vertically spaced apart relation within the cooling compartment and in horizontally spaced relation from the door, the space between the door and the storage racks defining a cooling air flow zone.

The cooler door display rack has a generally flat, horizontal shelf surface for supporting products placed thereon. A first front wall, a first rear wall, and two side walls extended vertically upwardly from the peripheral edges of the shelf surface, thereby forming an open top box having a bottom, front, rear and two sides. The display rack includes securement means for securing the display rack to the inside surface of the cooler door such that the first front wall is located adjacent the transparent door interior face and such that the display rack extends into the cooling air flow zone when the transparent door is closed.

Advertisement display means is operatively associated with the first front wall for receiving and supporting advertising indicia that will be visible through the transparent door of the cooler.

The advertisement display means may be upright second front and second rear walls mounted in horizontally spaced relation from and generally parallel to the first front and the first rear walls respectively of the display rack, thereby defining a message receiving space between the first and second front walls and another message receiving space between the first and second rear walls. The second front and second rear walls are constructed of either a generally transparent material or of a material having a substantial opening formed therein such that advertising indicia placed in the space between the first front wall of the display rack and the second front wall may be seen through the transparent door of the cooler. Similarly, advertising indicia placed in the space between the first rear wall of the display rack and the second rear wall is visible to customers viewing the rear of the rack when the door is open. The advertising indicia may be advertising or promotional message placards adapted to be slidably inserted into the message receiving spaces for viewing by the consuming public. The message placards may be electronic message boards and may be secured to the rack for electronic display of messages.

The display rack may also include a plurality of holes through the shelf surface for drainage of any condensation accumulating thereon.

The securement means may be one or more suction cups, or any other suitable fasteners, operative to secure the display rack to the interior face of the cooler door. A plurality of cooler door display racks may be secured to the transparent cooler door.

The display rack may also include a product retainer of generally the same dimensions as the shelf surface and mounted in vertically spaced relation above and generally parallel to the shelf surface and having openings therethrough such that products may be received through such openings and rest upon the shelf surface.

DESCRIPTION OF A PREFERRED EMBODIMENT

Figure 1:
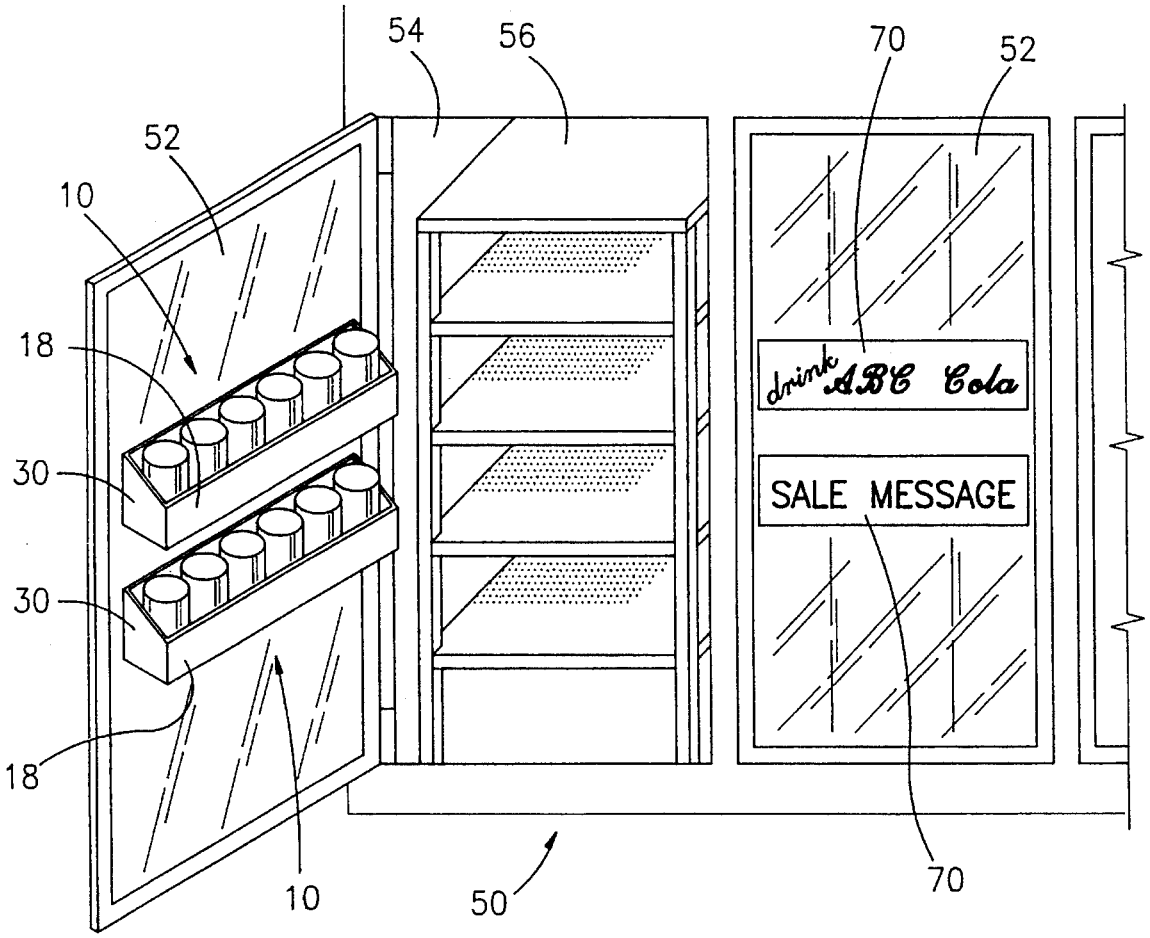
FIG. 1 is a front perspective view showing the display racks of the invention installed on the product access doors of conventional walk-in cooler.

FIG. 1 shows several display racks 10 installed in a conventional walk-in retail display cooler 50. Also shown in FIG. 1 are the conventional storage racks 56 upon which products are stored for purchase by consumers. The storage racks 56 are arranged in cooling compartment 54. FIG. 1 also shows the racks on both open and closed doors 52. A plurality of racks 10 may be secured to the doors 52, increasing storage efficiency of the cooler 50.

Advertising or promotional messages 70 placed in the front of the display rack are visible to consumers when approaching the cooler to make a purchase. In an alternative embodiment, an electronic message board may be used as the message placard with the message electronically displayed. Thus an advertising or promotional message may be very effectively conveyed to the consumer at precisely the point at which he or she is making the purchasing decision and product selection.

The display racks of the invention may be installed in various types of coolers or storage compartments including conventional free standing units, as well as the walk-in variety wherein store clerks fill the storage racks from the backside.

Figure 2:
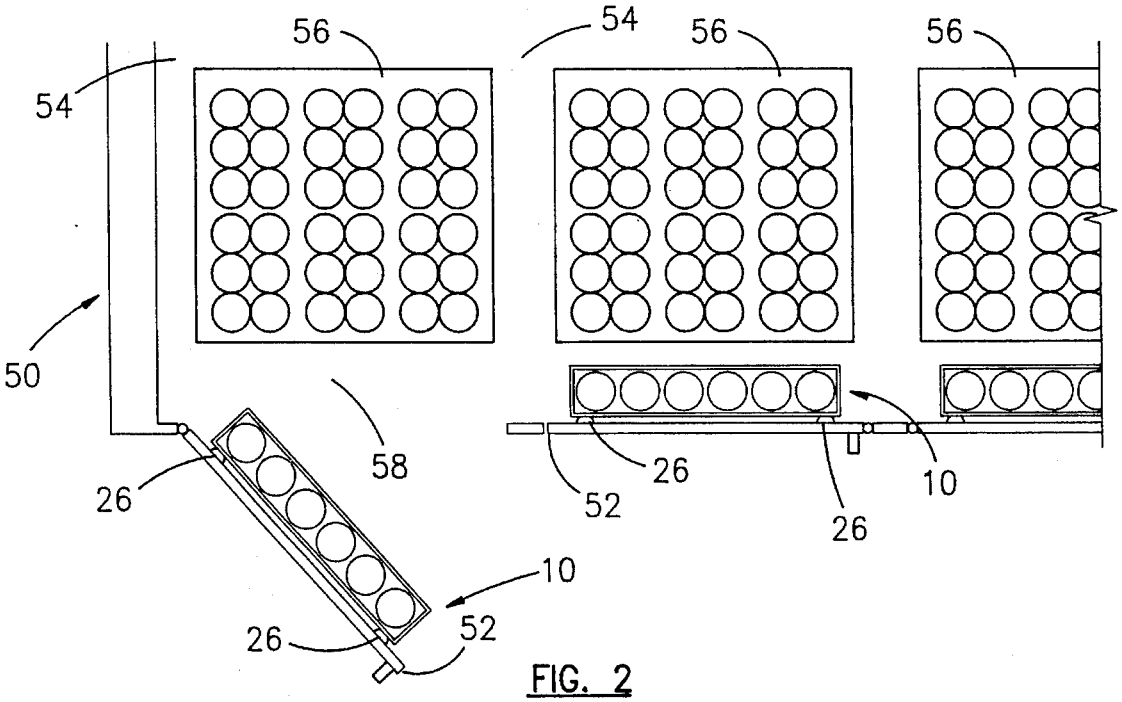
FIG. 2 is a top view of the display racks as installed on the cooler door as shown in FIG. 1.

FIG. 2 is a top view showing display racks 10 installed on both open and closed doors of a cooler. In the open door configuration, it can be seen that the apparatus 10 is secured to door 52 by securement means 26. Securement means 26 may be suction cups, hooks, snaps, velcro, adhesive, or any number of devices which allow the apparatus to be secured to the door 52. Securement means 26 should allow the apparatus 10 to be quickly and easily installed or removed, but should also provide for a sturdy attachment of the apparatus 10 to the door 52. Also shown are the horizontal storage racks 56 upon which products to be sold are stored. The racks 56 are located within the recessed cooling or storage compartment 54 which is defined by the walls of the cooler or storage compartment 50. A space is defined between the door 52 and the front of the storage racks 56. This space is referred to as the cooling air flow or free zone 58 and is the space in which the display racks 10 are situated when the door 52 is closed. The display rack 10 is designed such that sufficient space is left in the cooling air flow zone 58 when the door is closed to allow for adequate circulation. This may be important when the apparatus is installed in a cooler wherein an adequate circulation of air is required for efficient operation of the cooler.

Figure 3:
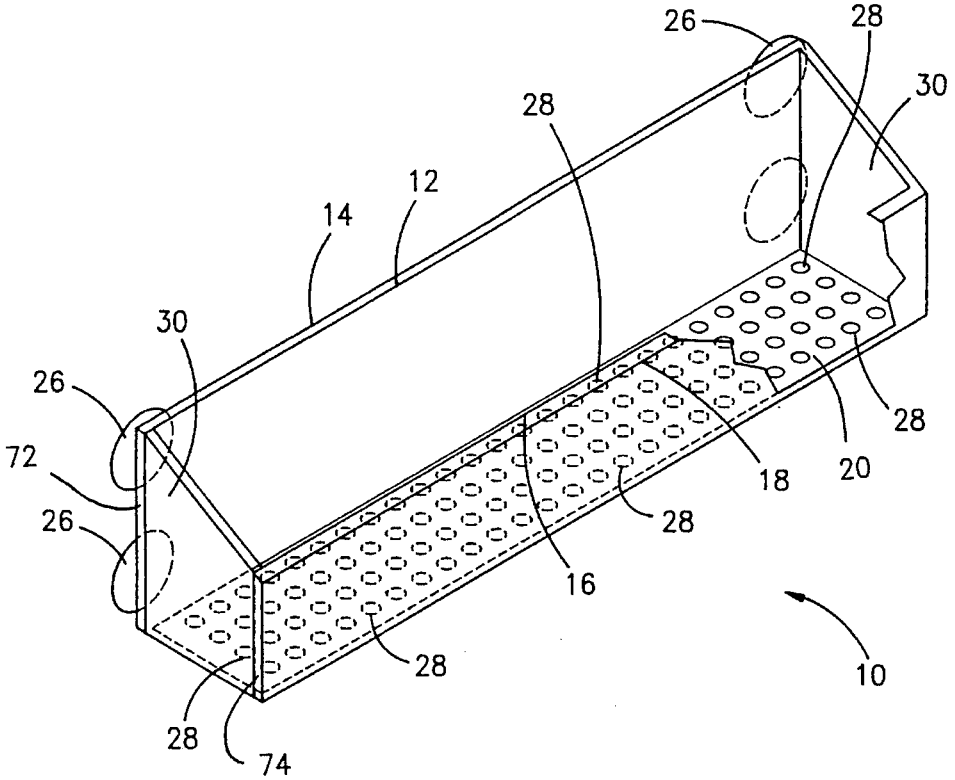
FIG. 3 is a rear perspective view of the display rack.

FIG. 3 is a detailed rear quarter perspective view of the present invention. A generally flat elongated support shelf 20 is connected with a first front wall 12, two side walls 30, and a first rear wall 26 which provide retention means for product on the shelf 20, thereby forming an elongated, open top box. Additionally, a second rear wall 18 is mounted in a horizontally spaced relation from the first rear wall 16 such that a rear message receiving slot 74 is formed therebetween. Similarly, a second front wall 14 is mounted in horizontally spaced relation from the first front wall 12, thereby forming a front message slot 72 therebetween. In a preferred embodiment, the walls of the apparatus are constructed of a transparent material such as acrylic so that any message placards placed within the two message receiving slots 72 and 74 may be seen when viewing the apparatus. Alternately, the second front and rear walls may simply have a large enough opening formed therein for viewing the message placards in the respective slots. Likewise it is important for the cooler or storage compartment door 52 to be constructed of a transparent material, thereby allowing the message displayed in front message receiving slot 72, to be seen by consumers as they approach the cooler. It is preferred that the front message receiving slot 72 be of a size and shape to accommodate messages 70 of varying sizes. However, to enable consumers to easily view advertisements on the display rack 10, it is preferred that the message placards 70 have an area of at least half the area of the first front wall 12, thereby presenting a substantial advertising display to consumers. It is also preferred that the message placards 70 each have a length of at least half the length of the elongated support shelf 20 and preferably be substantially the same length as the shelf 20, to better display advertising indicia thereon. It is also within the scope of the invention that an electronic message board be used as the message placard, and the message electronically displayed.

The horizontal elongated support shelf 20 will preferably have numerous drainage holes 28 therethrough. The drainage holes 28 provide a means for any condensation forming on products, such as pop cans or the like, and collecting on the shelf 20, to be drained therefrom.

Figure 4:
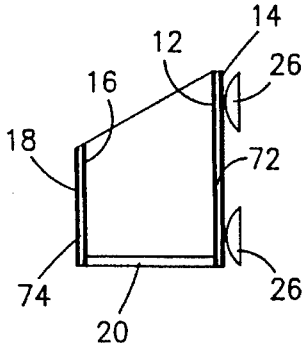
FIG. 4 is a side view thereof.
Figure 5:
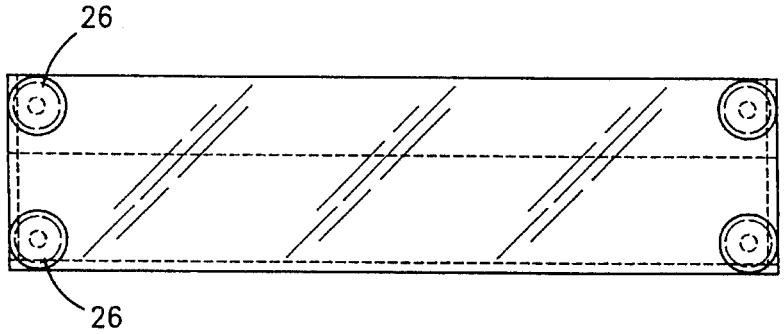
FIG. 5 is a front view of the display rack showing the suction cup securement means.
Figure 6:
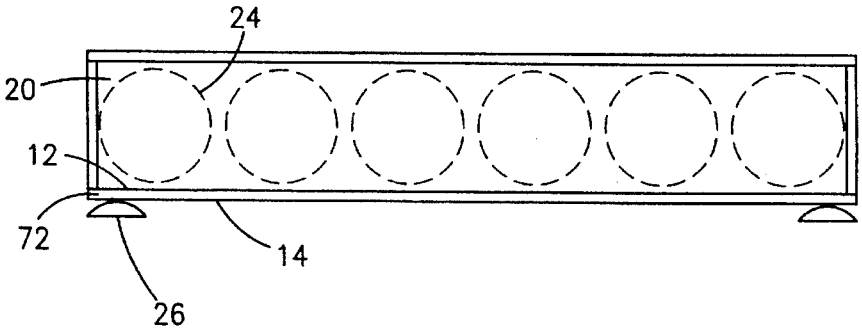
FIG. 6 is a top view of the display rack showing the shelf surface with beverage cans indicated thereon in dotted lines.

FIGS. 4, 5, and 6 show side, front, and top views respectively of the apparatus. Shown clearly in FIG. 4 is the first front wall 12, second front wall 14, and the message receiving slot 72 defined therebetween, and the first rear wall second rear wall 18, and the message receiving slot 74 defined therebetween. Also shown is the horizontal elongated support shelf 20 to which the walls are attached, and the suction cup securement means 26. The attachment and arrangement of the suction cup means 26 is also seen in FIG. 5. FIG. 6 shows the apparatus from the top perspective, and the orientation and spacing of can products on the elongated support shelf 20. Also shown in FIG. 6 is the horizontally spaced relation between the first front wall 12, the second front wall 14, and the message receiving space 72 defined therebetween.

Figure 7:
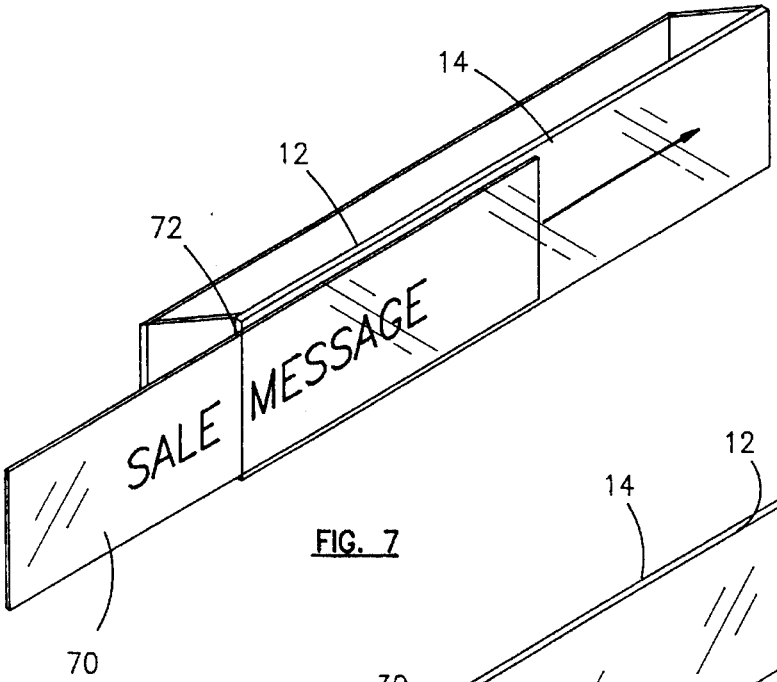
FIG. 7 is a front perspective view showing an advertising or promotional message placard being slidably inserted into the rack for viewing by consumers.
Figure 8:
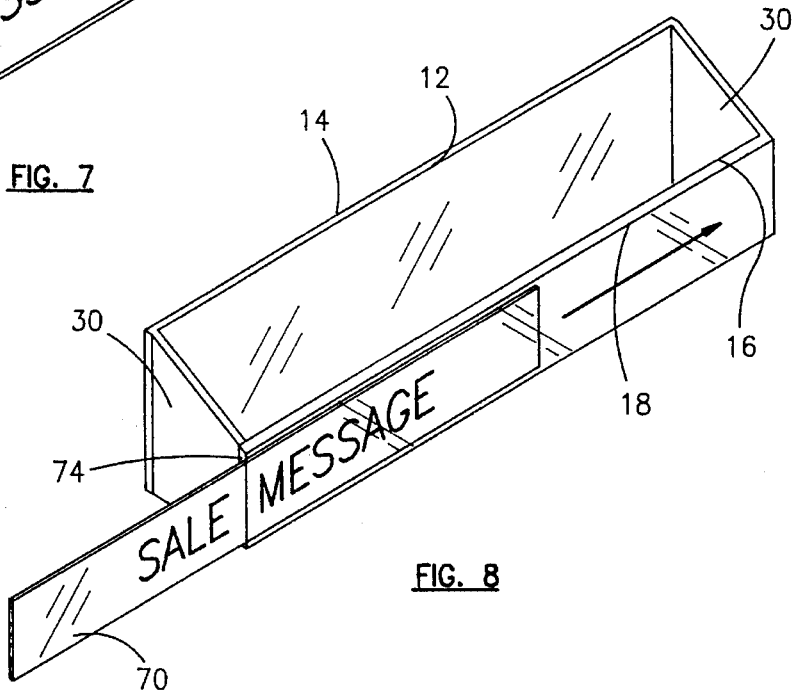
FIG. 8 is rear perspective view showing an advertising or promotional message placard being inserted into the rear slot of the rack.
Figure 10:
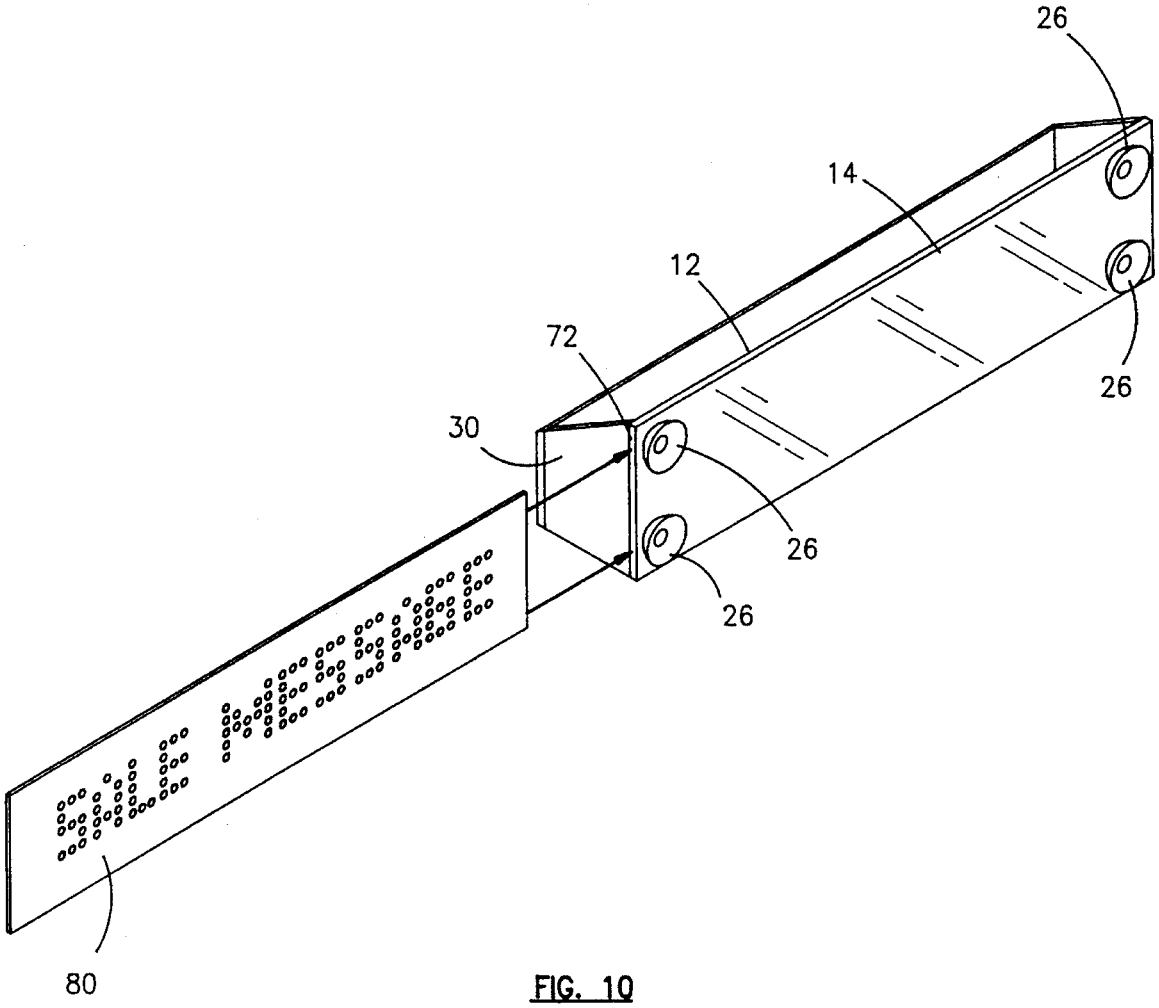
FIG. 10 is a front perspective view showing the installation of an electronic message board into the front slot of the rack for viewing by consumers.

FIGS. 7, 8, and 10 illustrate the advertising or promotional message display feature of the invention. As seen in FIG. 7, the advertising or promotional indicia may take the form of a placard 70 slidably inserted into the front message receiving slot defined by the first front wall 12 and the second front wall 14. Due to the transparent nature of the door 52 (not shown) and the transparent nature of the material used to construct the second front wall 14, any message placard placed within the front message receiving slot 72 may be seen by consumers approaching the cooler. Thus, a powerful advertising medium is provided whereby consumers receive the message precisely at the point at which they are making their purchasing and selection decisions.

FIG. 8 shows another advertising or promotional message placard 70 being slidably inserted into the rear message receiving space 74 defined by the first rear wall 16 and the second rear wall 18. Due to the transparent construction of the second rear wall 18, any message placed within the rear message receiving space 74, is visible to customers when the door 52 is open. Alternatively, as shown in FIG. 10, the message placard may comprise an electronic message board 80 with the message being displayed electronically. As with the other message placards, the electronic message board 80 is slidably received into the front message receiving space 72 defined by the first and second front walls 12 and 14.

Figure 9:
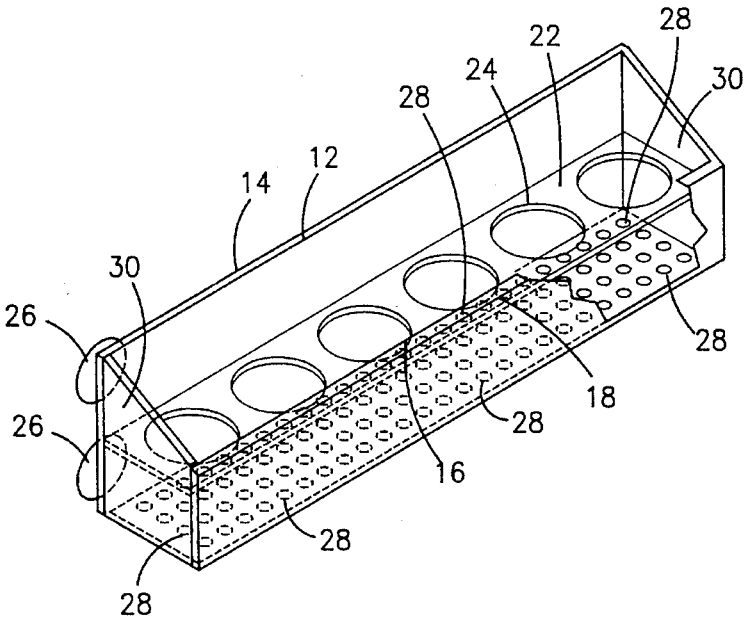
FIG. 9 is another embodiment of the invention with a product retainer shelf.

FIG. 9 shows an alternate embodiment wherein an additional product retainer shelf 22, is mounted generally parallel to and above the elongated support shelf 20. The product retainer shelf 22 would serve to restrain products such as beverage cans when the door 52 is abruptly opened or closed. The retaining shelf 2 is entirely optional and would not be used when products other than cans are displayed.

The invention furthermore contemplates a method for providing additional storage and advertising space in a cooler, including the steps of providing the display racks of the invention, securing them to the interior face of a cooler door and displaying message indicia on the rack so that the message indicia is visible through the transparent door of the cooler as previously described.

While the invention has been described in a preferred embodiment, it will be seen that many modifications, additions, and alternatives are possible which are within the intended broad scope of the appended claims. For example, whereas the message indicia is shown as either a placard with a printed message thereon or an electronic message board, it alternately could take such various forms as decals or printing on the front face of the display rack. The means for supporting the message indicia on the front of the display rack need not be a full second front wall but could simply be vertically spaced apart flanges, for example, for slidably receiving a placard or the like therebetween.

Thus there has been shown and described a cooler door display rack which accomplishes at least all of the stated objectives.

I claim:

1. A cooler door display rack for a cooler having a frame at least partially defining a cooling compartment, a transparent door pivotally mounted on said frame and having interior and exterior faces, storage racks mounted in vertically spaced apart relation within the cooling compartment and in horizontally spaced relation from the door, the space between the door and the storage racks defining a cooling air flow zone, the cooler door display rack comprising, an elongated support shelf of a shape for supporting a plurality of beverage containers generally in a row, said shelf having front, back and side peripheral edges, retention means operatively associated with said support shelf for retaining beverage containers thereon and obstructing sliding movement of beverage containers off of said shelf, said retention means including a first front wall, rear retention means and side retention means, said first front wall attached to said elongated support shelf adjacent said front edge, said first front wall extending upwardly from said elongated support shelf, said first front wall having a greater surface area than said rear retention means and said side retention means, advertising display means operatively associated with said support shelf for removably and replacebly receiving and supporting advertising indicia in upright relation adjacent said front edge, said advertising display means being of a size and shape such that advertising indicia supported therein cover at least half the area of said first front wall, and securement means for securing said shelf to the inside surface of a transparent door such that advertising indicia supported on said advertising display means is arranged adjacent to and visible through the transparent door.

2. The cooler door display rack of claim 1 wherein said advertisement display means extends upwardly from said support shelf at least as high as said securement means.

3. The cooler door display rack of claim 1 wherein said rear and side retention means each further comprise a first rear wall and two side walls, respectively, said walls attached to said elongated support shelf adjacent, respectively, said back edge and said side perpheral edges, said walls extending upwardly from said elongated support shelf thereby forming an open top box having a bottom, front, rear and two sides.

4. The cooler door display rack of claim 1 wherein said advertising display means comprises an upright rigid second front wall mounted in horizontally spaced relation from and generally parallel to said first front wall of said display rack and thereby defining a front message receiving space between said first and second front walls and wherein said second front wall is constructed of a material being generally transparent such that the advertising indicia placed within the space defined by the first front wall of said display rack and said second front wall may be seen through a transparent door of a cooler.

5. The cooler door display rack of claim 4 further comprising an upright rigid second rear wall mounted in horizontally spaced relation from and generally parallel with said first rear wall of said display rack, thereby defining a rear message receiving space between said first and second rear walls and wherein said second rear wall is constructed of a material being generally transparent such that advertising indicia placed in said rear message receiving space are visible through said second rear wall.

6. The invention of claim 4 wherein said message placard is an electronic message board.

7. The cooler door display rack of claim 1 wherein said elongated support shelf further comprises a plurality of holes therethrough for drainage of any condensation accumulating on said shelf surface.

8. The cooler door display rack of claim 1 wherein said securement means comprises at least one suction cup operative to secure said display rack to an interior face of a cooler door.

9. The cooler door display rack of claim 1 further comprising a plurality of said cooler door display racks.

10. The cooler door display rack of claim 1 wherein said retention means comprises a container retaining shelf being of generally the same dimension as said elongated support shelf and mounted in vertically spaced relation above and generally parallel with said elongated support shelf and having openings therethrough such that a product may be received through such openings and rest upon said elongated support shelf.

11. In combination, a cooler comprising a frame at least partially defining a cooling compartment, a transparent door pivotally mounted on said frame and having interior and exterior faces, storage racks mounted in vertically spaced relation within the cooling compartment and in horizontally spaced relation from the door, the space between the door and the storage racks defining a cooling air flow zone; and a cooler door display rack, comprising:

an elongated support shelf of a shape for supporting a plurality of beverage containers generally in a row, said shelf having front and back edges, a first front wall attached to said shelf surface adjacent the front edge thereof and extending upwardly from said shelf surface, said front wall having front and back surfaces, a sheet-like advertising placard of a size having a front surface of an area at least half of the area of said front surface of said front wall such that such placard is of a size to readily convey advertising information thereon to consumers, slot means connected to said front wall for slidably and removably receiving and supporting said advertising placard in upright relation adjacent said front wall, retention means operatively associated with said support shelf for retaining beverage containers thereon and obstructing sliding movement of beverage containers off of said shelf, and securement means for securing said shelf to the inside surface of a transparent door such that an advertising placard supported in said slot means is arranged adjacent to and visible through the transparent door.

12. In combination, a cooler comprising a frame at least partially defining a cooling compartment, a transparent door pivotally mounted on said frame and having interior and exterior faces, storage racks mounted in vertically spaced relation within the cooling compartment and in horizontally spaced relation from the door, the space between the door and the storage racks defining a cooling air flow zone; and a cooler door display rack, comprising, an elongated support shelf of a shape for supporting a plurality of beverage containers generally in a row, said shelf having front, back and side peripheral edges, retention means including a first front wall and a first rear wall, said walls attached to said elongated support shelf adjacent, respectively, said front edge and said back edge, said walls extending upwardly from said elongated support shelf, said first front wall having a greater surface area than said first rear wall, advertising display means including an upright second front wall mounted in horizontally spaced relation from and generally parallel to said first front wall of said display rack and thereby defining a front message receiving space between said first and second front walls such that the advertising indicia placed within the space defined by the first front wall of said display rack and said second front wall may be seen through the transparent door of a cooler, said advertising display means being of a size and shape such that advertising indicia supported therein cover at least half the area of said first front wall, and securement means for securing said shelf to the inside surface of a transparent door such that advertising indicia supported on said advertising display means is arranged adjacent to and visible through the transparent door.

13. A cooler door display rack for a cooler having a frame at least partially defining a cooling compartment, a transparent door pivotally mounted on said frame and having interior and exterior faces, storage racks mounted in vertically spaced apart relation within the cooling compartment and in horizontally spaced relation from the door, the space between the door and the storage racks defining a cooling air flow zone, the cooler door display rack comprising, an elongated support shelf of a shape for supporting a plurality of beverage containers generally in a row, said shelf having front, back and side peripheral edges, retention means operatively associated with said support shelf for retaining beverage containers thereon and obstructing sliding movement of beverage containers off of said shelf, said retention means including a first front wall, said first front wall attached to said elongated support shelf adjacent said front edge, said first front wall extending upwardly from said elongated support shelf, said first front wall having a greater surface area than said elongated support shelf, advertising display means operatively associated with said support shelf for removably and replaceably receiving and supporting advertising indicia in upright relation adjacent said front edge, said advertising display means being of a size and shape such that advertising indicia supported therein cover at least half the area of said first front wall, and securement means for securing said shelf to the inside surface of a transparent door such that advertising indicia supported on said advertising display means are arranged adjacent to and visible through the transparent door.

* * * * *